US011788341B2

(12) United States Patent
Franson et al.

(10) Patent No.: US 11,788,341 B2
(45) Date of Patent: Oct. 17, 2023

(54) EXTRUDED FRAME SYSTEM FOR GLAZING

(71) Applicant: Window Film Depot, Inc., Marietta, GA (US)

(72) Inventors: Jeffrey Franson, Marietta, GA (US); Mark Meshulam, Northbrook, IL (US)

(73) Assignee: Window Film Depot, Inc., Marietta, GA (US)

( * ) Notice: Subject to any disclaimer, the term of this patent is extended or adjusted under 35 U.S.C. 154(b) by 0 days.

(21) Appl. No.: 17/586,458

(22) Filed: Jan. 27, 2022

(65) Prior Publication Data

US 2022/0145692 A1 May 12, 2022

Related U.S. Application Data

(63) Continuation-in-part of application No. 17/066,788, filed on Oct. 9, 2020, now Pat. No. 11,680,441.

(51) Int. Cl.

| | |
|---|---|
| ***E06B 3/28*** | (2006.01) |
| ***E06B 1/18*** | (2006.01) |
| ***E06B 3/16*** | (2006.01) |
| ***E06B 7/10*** | (2006.01) |
| ***E06B 5/11*** | (2006.01) |
| ***E06B 3/54*** | (2006.01) |

(52) U.S. Cl.

CPC ..... *E06B 1/18* (2013.01); *E06B 3/16* (2013.01); *E06B 3/549* (2013.01); *E06B 5/11* (2013.01); *E06B 7/10* (2013.01)

(58) Field of Classification Search

CPC ..... E06B 1/18; E06B 3/16; E06B 3/28; E06B 3/549; E06B 3/64; E06B 5/11; E06B 7/10; E06B 7/11

USPC ..... 52/203

See application file for complete search history.

(56) References Cited

U.S. PATENT DOCUMENTS

| | | | | |
|---|---|---|---|---|
| 3,686,795 A * | 8/1972 | La Barge | E06B 7/12 | 49/504 |
| 3,874,135 A * | 4/1975 | Craven | E06B 3/16 | 52/656.6 |
| 4,215,517 A * | 8/1980 | Everson | E06B 3/28 | 52/800.16 |
| 4,314,424 A * | 2/1982 | Gordon | E06B 3/308 | 49/495.1 |
| 6,509,071 B1 * | 1/2003 | Emek | F41H 5/263 | 52/204.593 |
| 7,490,445 B2 * | 2/2009 | Steffek | E06B 3/6604 | 52/456 |

(Continued)

*Primary Examiner* — Brian E Glessner
*Assistant Examiner* — James J Buckle, Jr.
(74) *Attorney, Agent, or Firm* — Bryan W. Bockhop; Bockhop Intellectual Property Law, LLC

(57) ABSTRACT

A frame system for securing a glazing unit to a window portal includes an elongated primary mount extrusion, an elongated mount stop extrusion, an elongated first gasket, an elongated second gasket and a structural sealant. The primary mount extrusion is secured to the window portal. A mount stop extrusion engages the primary mount extrusion with a pair of ratcheting members. The first gasket and the second gasket define a passage therebetween and the passage has a width so that the glazing unit fits therein. A structural sealant is disposed so as to affix the glazing unit to an inner upper surface of the primary mount extrusion.

23 Claims, 9 Drawing Sheets

(56) References Cited

U.S. PATENT DOCUMENTS

| | | | | |
|---|---|---|---|---|
| 7,765,769 | B2 * | 8/2010 | Rosskamp | E06B 3/677<br>52/204.6 |
| 11,585,150 | B1 * | 2/2023 | Campbell | E06B 3/66309 |
| 2002/0184839 | A1 * | 12/2002 | Emek | E06B 1/02<br>49/504 |
| 2015/0184684 | A1 * | 7/2015 | Lathief | E06B 3/5871<br>403/330 |
| 2018/0320433 | A1 * | 11/2018 | Ting | E06B 3/6715 |
| 2020/0003002 | A1 * | 1/2020 | Walter | E06B 3/5821 |
| 2023/0151678 | A1 * | 5/2023 | Campbell | E06B 3/2605<br>52/203 |

* cited by examiner

EXTRUDED FRAME SYSTEM FOR GLAZING

CROSS-REFERENCE TO RELATED APPLICATION(S)

This application is a continuation-in-part of, and claims the benefit of, U.S. patent application Ser. No. 17/066,788, filed Oct. 9, 2020, the entirety of which is hereby incorporated herein by reference.

BACKGROUND OF THE INVENTION

1. Field of the Invention

The present invention relates to glazing systems and, more specifically, to a frame system for glazing units.

2. Description of the Related Art

Glazing systems typically include one or more glass panes that are secured to a window opening by a frame. The typical frame used in commercial glazing includes a hollow frame member (which can include a combination of structures), which is secured to the window opening. The aluminum frame member holds the glass panes between a pair of aluminum glazing legs and elongated rubber gaskets that seal the panes to the glazing legs.

Security panels are often applied to glazing systems for such purposes as preventing forced entry and damage due to vandalism. There is a high demand for security panels being installed on storefront glazing systems and at other vulnerable sites. Such security panels frequently include polycarbonate sheets that are secured to the window frame.

In a typical system, humidity can build up in the space between the security panel and the glass pane, which can cause unsightly fogging of the pane and the security panel. To reduce such fogging, installers often drill holes through the spacer so that the cavity is in communication with the outside air. However, on humid days, the air in the cavity can have high outside humidity that can condense on the glass panes as a result of cooler inside temperatures due to air conditioning.

Many frame and glass systems involve many parts that must be assembled with fasteners and the like. Such assembly can be time consuming and labor intensive.

Therefore, there is a need for frame system for glazing units that can be installed quickly with a minimum number of fasteners.

SUMMARY OF THE INVENTION

The disadvantages of the prior art are overcome by the present invention which, in one aspect, is a frame system for securing a glazing unit to a window portal attachment surface that includes an elongated primary mount extrusion, an elongated mount stop extrusion, an elongated first gasket, an elongated second gasket and a structural sealant. The elongated primary mount extrusion has a vertical wall with a top leg extending therefrom and a bottom leg extending therefrom. The top leg has a first end that defines a first gasket engagement channel. The bottom leg has a second end that defines a first one-way ratcheting engagement member. The primary mount extrusion is configured to be secured to the window portal attachment surface. The elongated mount stop extrusion has a top end that defines a second gasket engagement channel that is spaced apart from and parallel to the first gasket engagement channel. The mount stop extrusion has a bottom end that defines a second one-way ratcheting engagement member that is complementary to the first one-way ratcheting engagement member so that the mount stop extrusion is affixed to the primary mount extrusion when the second one-way ratcheting engagement member is engaged with the first one-way ratcheting engagement member. The elongated first gasket is configured to be engaged with the first gasket engagement channel and the elongated second gasket is configured to be engaged with the second gasket engagement channel. The first gasket and the second gasket define a passage therebetween once engaged and the passage has a width so that the glazing unit fits therein. The structural sealant is configured to be disposed so as to affix the glazing unit to an inner upper surface of the primary mount extrusion.

In another aspect, the invention is a window system that includes a glazing unit, an elongated primary mount extrusion, an elongated mount stop extrusion, an elongated first gasket, an elongated second gasket and a structural sealant. The elongated primary mount extrusion has a vertical wall with a top leg extending therefrom and a bottom leg extending therefrom. The top leg has a first end that defines a first gasket engagement channel. The bottom leg has a second end that defines a first one-way ratcheting engagement member. The primary mount extrusion is configured to be secured to the window portal attachment surface. The elongated mount stop extrusion has a top end that defines a second gasket engagement channel that is spaced apart from and parallel to the first gasket engagement channel. The mount stop extrusion has a bottom end that defines a second one-way ratcheting engagement member that is complementary to the first one-way ratcheting engagement member so that the mount stop extrusion is affixed to the primary mount extrusion when the second one-way ratcheting engagement member is engaged with the first one-way ratcheting engagement member. The elongated first gasket is configured to be engaged with the first gasket engagement channel and the elongated second gasket is configured to be engaged with the second gasket engagement channel. The first gasket and the second gasket define a passage therebetween once engaged and the passage has a width so that the glazing unit fits therein. The structural sealant is configured to be disposed so as to affix the glazing unit to an inner upper surface of the primary mount extrusion.

In yet another aspect, the invention is a method of securing a polycarbonate panel to a window portal, in which an elongated primary mount extrusion is fastened to the window portal. The elongated primary mount extrusion has a vertical wall with a top leg extending therefrom and a bottom leg extending therefrom. The top leg has a first end that defines a first gasket engagement channel. The bottom leg has a second end that defines a first one-way ratcheting engagement member. An elongated first gasket is engaged with the first gasket engagement channel. A plurality of temps is secured to the primary mount extrusion. The plurality of temps includes a first set of temps adapted to provide vertical glazing unit support and second set of temps adapted to provide lateral glazing unit support. The temps of the first set are spaced apart from and alternated with temps of the second set. The polycarbonate panel is placed on the temps of the first set and between the first gasket and the temps of the second set. A structural sealant is applied between the glazing unit and an inner upper surface of the primary mount extrusion, thereby affixing the glazing unit to the primary mount extrusion. An elongated mount stop extrusion is affixed to the primary mount extrusion. The mount stop extrusion has a top end that defines a second gasket engagement channel in which an elongated second gasket is engaged. The second gasket is placed against the polycarbonate sheet. The mount stop extrusion has a bottom end that defines a second one-way ratcheting engagement member that is complementary to the first one-way ratcheting engagement member so that the mount stop extrusion is affixed to the primary mount extrusion by pressing the second one-way ratcheting engagement member into the first one-way ratcheting engagement member.

These and other aspects of the invention will become apparent from the following description of the preferred embodiments taken in conjunction with the following drawings. As would be obvious to one skilled in the art, many variations and modifications of the invention may be effected without departing from the spirit and scope of the novel concepts of the disclosure.

DETAILED DESCRIPTION OF THE INVENTION

Figure 1:
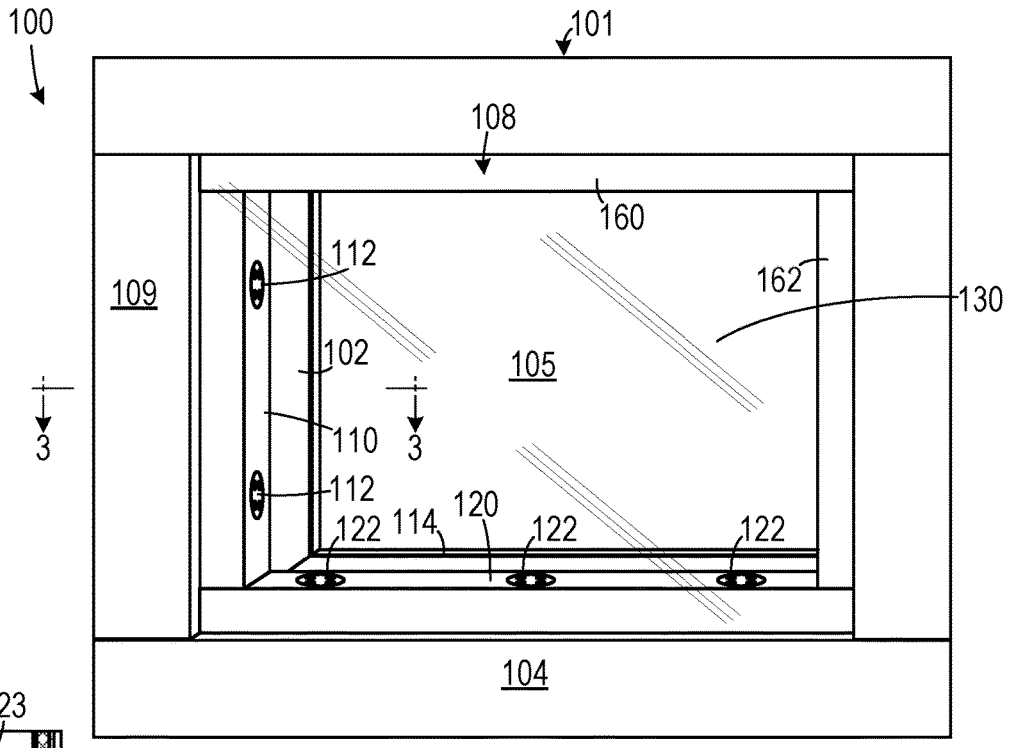
FIG. 1 is a front perspective view of one representative embodiment of a vented glazing security unit.
Figure 2A:
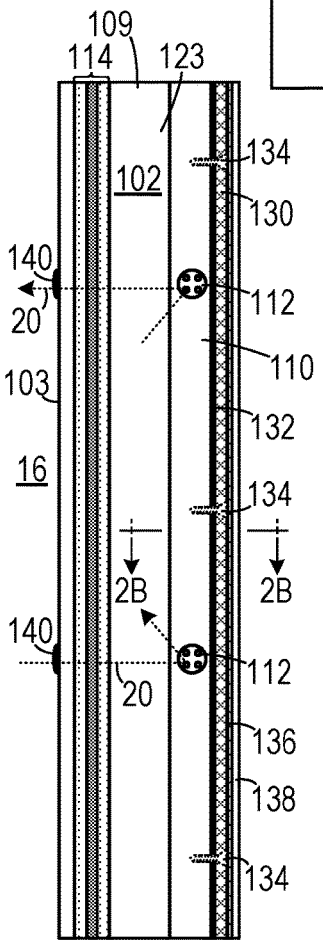
FIG. 2A is a schematic view of the vented glazing security unit looking at a bar affixed to a window frame.
Figure 2B:
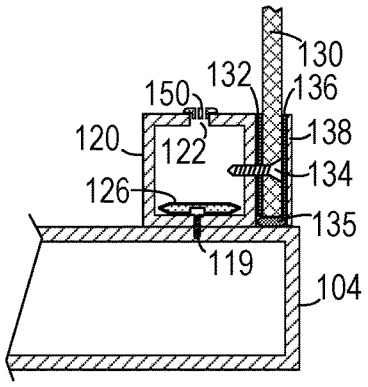
FIG. 2B is a detail showing the bottom tubular bar secured to the window frame and the security panel secured to the bottom tubular bar.
Figure 3:
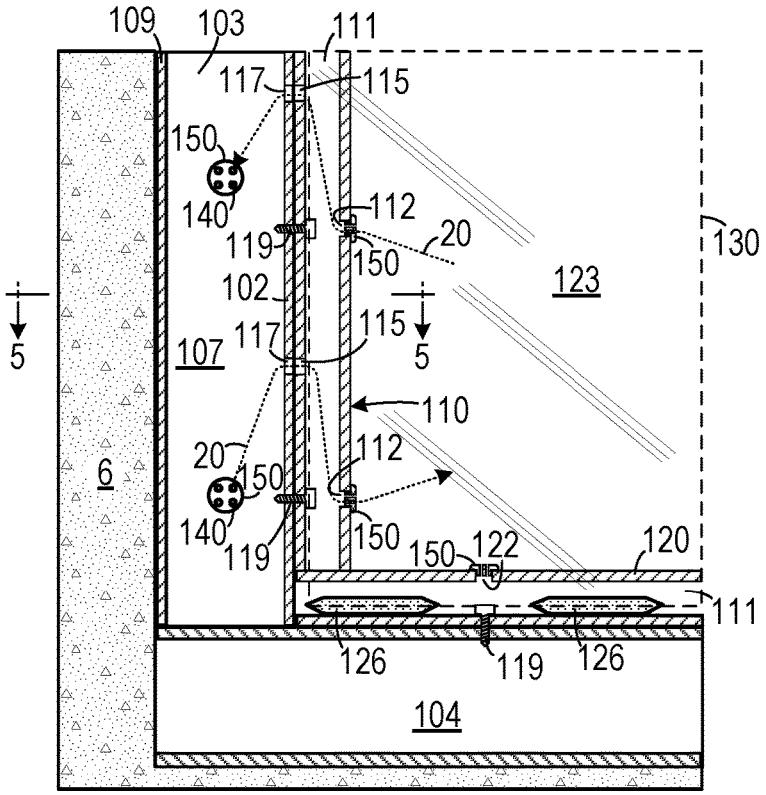
FIG. 3 is a cross-sectional view of a portion of the vented glazing security unit shown in FIG. 1 taken along line 3-3 and viewed from the exterior of the glazing unit.
Figure 4:
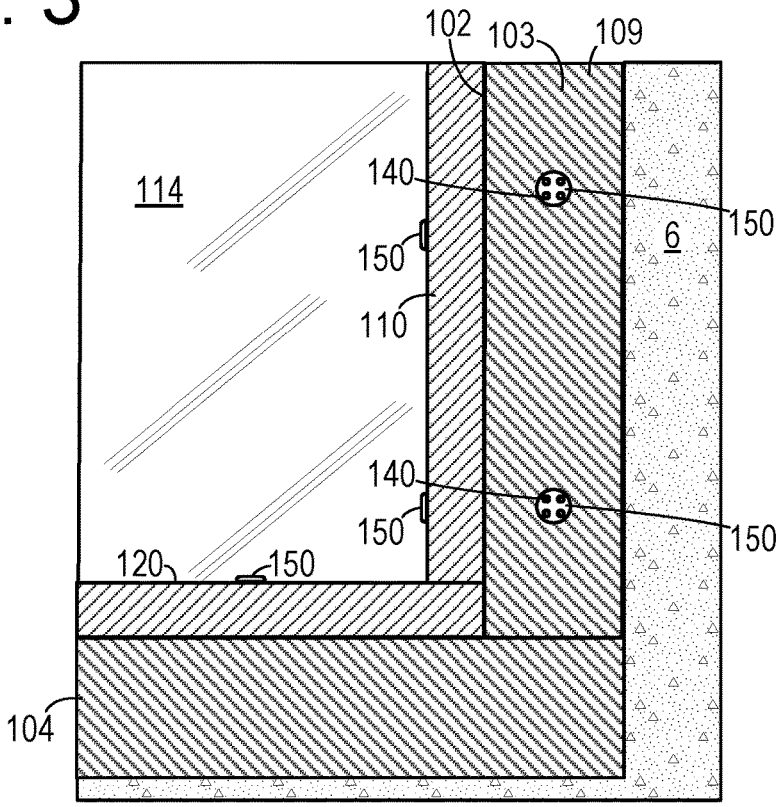
FIG. 4 is an elevational view of the portion of the vented glazing security unit shown in FIG. 3 and viewed from the interior of the glazing unit.
Figure 5:
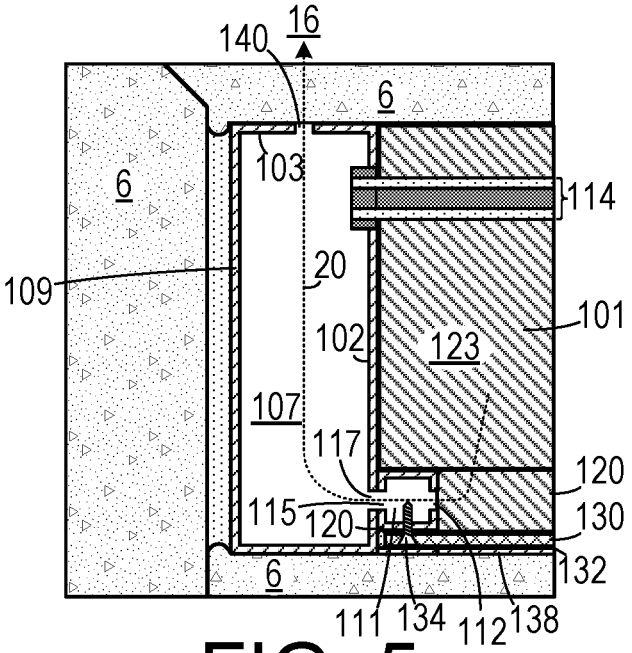
FIG. 5 is a cross-sectional view of a vertical bar and vertical portion of a window frame shown in FIG. 5 taken along line 5-5.

A preferred embodiment of the invention is now described in detail. Referring to the drawings, like numbers indicate like parts throughout the views. Unless otherwise specifically indicated in the disclosure that follows, the drawings are not necessarily drawn to scale. The present disclosure should in no way be limited to the exemplary implementations and techniques illustrated in the drawings and described below. As used in the description herein and throughout the claims, the following terms take the meanings explicitly associated herein, unless the context clearly dictates otherwise: the meaning of "a," "an," and "the" includes plural reference, the meaning of "in" includes "in" and "on."

As shown in FIGS. 1-5, one embodiment of a security unit 100 for protecting a window 105 includes a security panel 130 and a rectangular securing structure 108 that is affixed to the window frame 101 (that is mounted to a window portal 6) and to which the security panel 130 is affixed. The window 105 includes at least one glazing unit 114 that is supported by a window frame 101 (a double pane glazing unit 114 is shown). The security panel 130 is spaced apart from the glazing unit 114 so that an air cavity 123 is defined by the security panel 130 and the glazing unit 114.

The rectangular securing structure 108 includes a rectangular first vertical tubular bar 110, an oppositely disposed rectangular second vertical tubular bar 162, a rectangular bottom tubular bar 120 and an oppositely disposed rectangular top tubular bar 160. In certain embodiments, the bars in the rectangular securing structure 108 can have cross sectional shape other than rectangular. The bars can include extruded aluminum or other materials such as steel, composites, etc. The rectangular securing structure 108 is affixed to the window frame 101 with a plurality of fasteners, such as sheet metal screws 119. Other affixing devices can be used without departing from the scope of the invention.

The security panel 130 is typically made from a transparent shatter-proof panel, such as a high optic architectural grade polycarbonate sheet (for example, Tuffak® GP, available from Plaskolite, Inc. 400 W. Nationwide Blvd., Suite 400, Columbus, OH 43215). Typical polycarbonate sheet widths to prevent forced entry are in the range from ¼ inches to ⅜ inches and widths greater than 1 inches can be used in applications such as bullet-proofing. The security panel 130 is secured to the bars of the securing structure 108 initially with two-sided tape 132 that adheres both to the bars and to the periphery of the security panel 130. Counter-sunk screws 134 are then driven through the security panel 130 into securing structure 108.

The window frame 101 defines a void 107 therein. The window frame 101 has a vertical portion 109 with at least a front panel 103 and a side panel 102 (typically it will include a rectangle of units that each have a prismatic rectangular shape). The void 107 is in communication with an air space 16 through a plurality of external air vents 140 in the front panel 103 that are each drilled through the window frame 101. (In typical embodiments, the air space 16 is the interior of a store, an office or the like. However, in certain embodiments, the air space 16 is outside air.) While the window frame 101 is simplified herein as including rectangular prismatic sections, many other configurations of window frames are known to the art and the present invention can be adapted for use with any such frame that defines a void therein.

The side panel 102 defines a plurality of side panel holes 117 passing therethrough. At least one of the rectangular first vertical tubular bar 110 or the rectangular second vertical tubular bar 162 (and typically both) defines an elongated passage 111 therethrough that is in communication with the air cavity 123 through a plurality of air cavity vents 112 (also referred to as "Moore Vents"). The first vertical tubular bar 110 also defines a plurality of passage holes 115 that are each aligned with a different one of the plurality of side panel holes 117 so that the passage 111 is in communication with the void 107. Air 20 is able to circulate from the air cavity 123 to the air space 16 through the plurality of air cavity vents 112, the plurality of passage holes 115, the plurality of side panel holes 117 and the plurality of external air vents 140, thereby maintaining the air cavity temperature humidity at the external air temperature humidity of the air space 16. To ensure adequate air flow, the plurality of external air vents 140, the plurality of side panel holes 117, the plurality of air cavity vents 112 and the plurality of passage holes 115 each should have a combined area of at least one half square inch per 60 cubic inches of volume in the air cavity. Decorative vent covers 150 can be placed over the vents 112, 122 and 140 to provide a more aesthetic appearance. When such covers 150 are used, it is important to ensure that the total vent hole area of the covers 150 meet the criteria mentioned above.

In some embodiments, the bottom tubular bar 120 also defines an elongated passage 111 into which desiccant packets 126 are placed to absorb moisture during installation. This bar 120 is not vented into the bottom portion 104 of the window frame 101. At least one bottom bar vent 122 is drilled through the bottom bar 120 so that the desiccant 126 is in fluid communication with the air cavity 123 to absorb moisture during installation.

The security panel 130 can be secured to the securing structure 108 initially with a two-sided tape 132. A plurality of counter-sunk screws 134 can be driven through the security panel 130 into the securing structure 108 to provide additional securing force. A structural sealant caulk 135 can provide additional securing force and ensure that the security panel 130 has an airtight seal with the securing structure 108. (Examples of suitable structural caulk include Dow 995, Dow 795 and Dow 999-A.) A trim tab 138 can be affixed to the security panel 130 so as to cover the plurality of counter-sunk screws 134, so as to prevent tampering therewith and to provide a more aesthetic appearance.

Figure 6A:
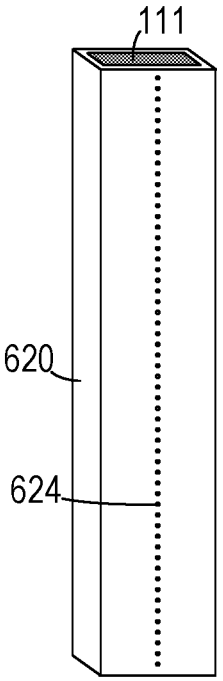
FIG. 6A is a perspective view of a square tubular bar that includes a perforated side.
Figure 6B:
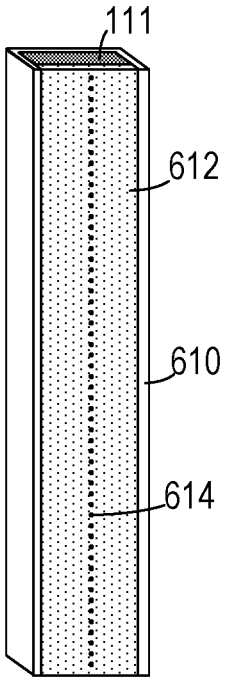
FIG. 6B is a perspective view of a U-channel bar with a perforated cap.

As shown in FIG. 6A, the bar 620 can include a line of perforations 624 drilled therethrough to act as vents. As shown in FIG. 6B, the bar 610 can be a U-shaped bar ("U-channel bar") with an elongated snap-on cap 612 that defines a plurality of perforations 614 therethrough.

Figure 7A:
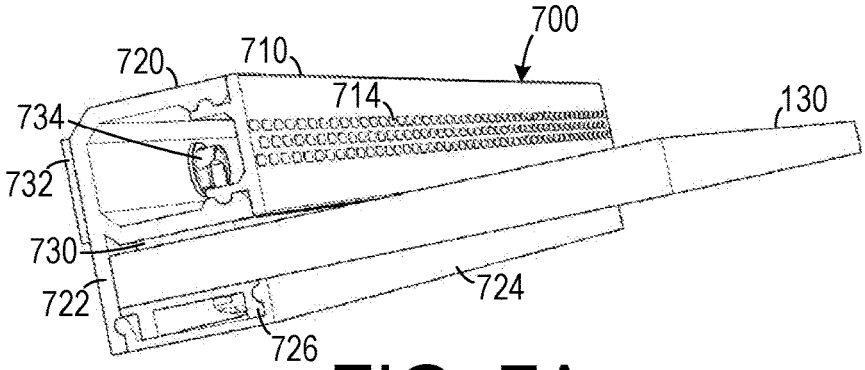
FIG. 7A is a first perspective view of one embodiment of a window security unit employing a U-channel bar with a perforated cap.
Figure 7B:
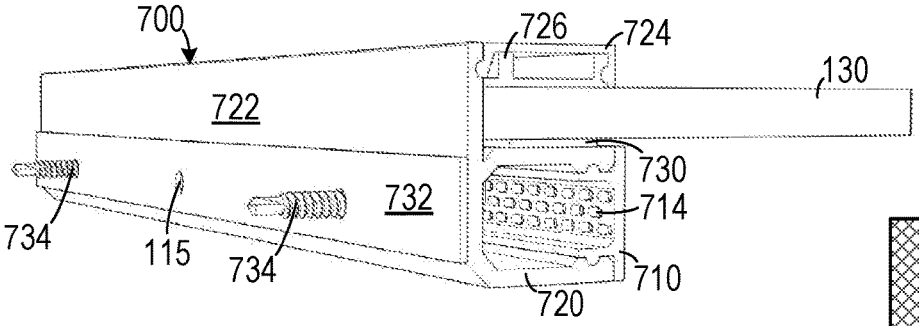
FIG. 7B is a second perspective view of the embodiment shown in FIG. 7A.
Figure 7C:
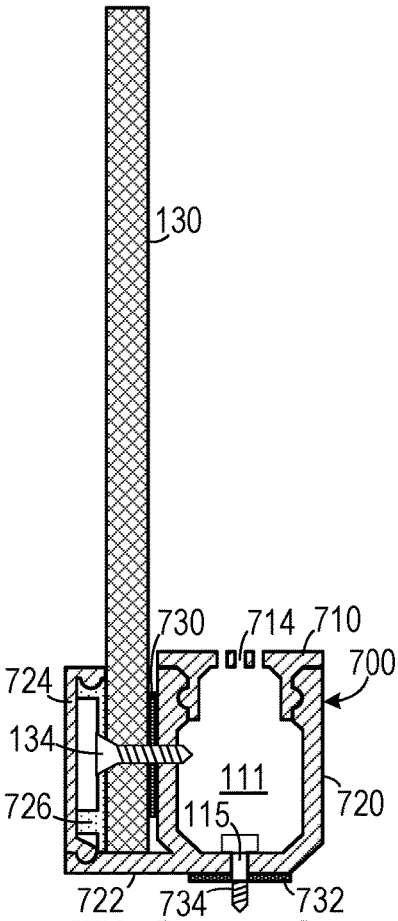
FIG. 7C is a cross-sectional view of the embodiment shown in FIG. 7A.

One example of an easy to install and attractive unit 700 is shown in FIGS. 7A-7C. This unit 700 includes a U-channel bar 720 with an integrated leg member 722 extending outwardly from the side that is secured to the window frame. A vented cap 710 that defines a plurality of holes 714 passing therethrough snaps onto the U-channel bar 720 after it has been secured to the window frame with two-sided tape 732 and screws 734. The security panel 130 is secured to the U-channel bar 720 with two-sided tape 730 and a plurality of screws 134. A bracket 726 is secured to the periphery of the security panel 130 with a plurality of screws 134. A cover 724 is then snapped onto the leg member 722 and the bracket 726 to hide the screws 134.

While in one embodiment, the air cavity is vented to the interior of a building, in certain embodiments the air cavity is vented to the outside. In certain embodiments, security units can be installed inside the glazing and in certain embodiments security units can be installed on both sides of the glazing.

Figure 8A:
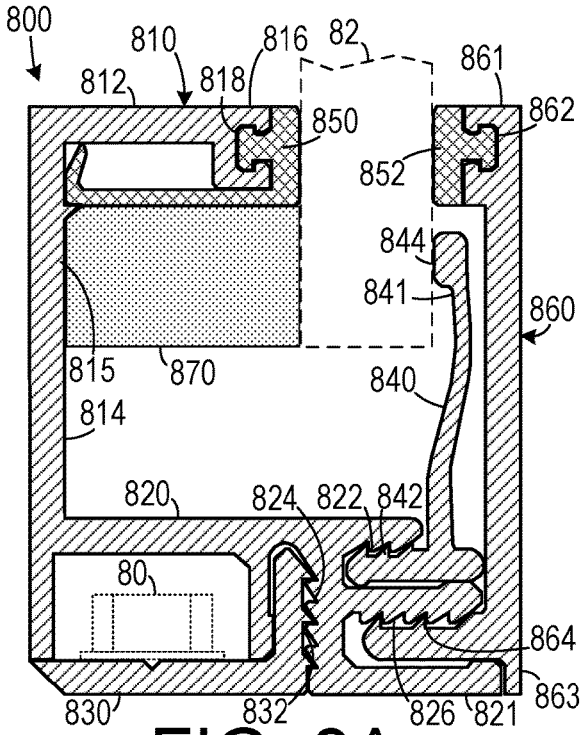
FIGS. 8A-8C are schematic diagrams of one embodiment of a frame system.
Figure 8B:
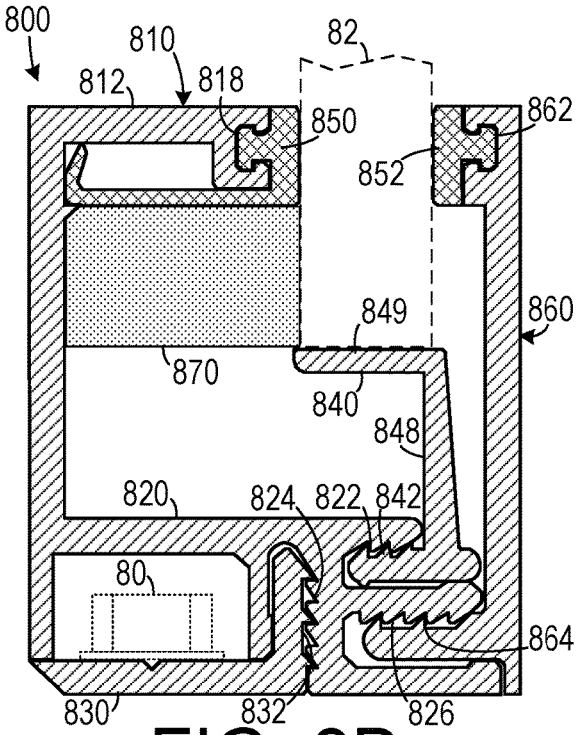
Figure 8C:
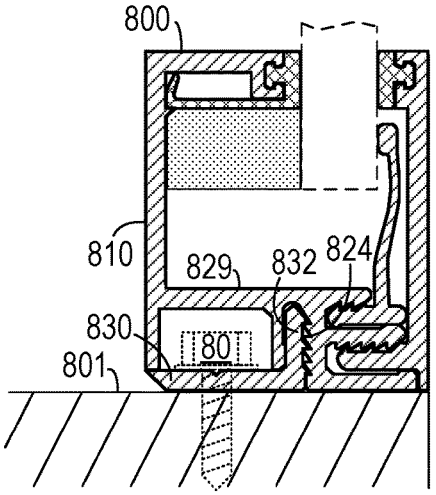

As shown in FIGS. 8A-8C, one embodiment of a frame system 800 for securing a glazing unit 82 (such as a security panel) to a window portal attachment surface 801 includes an elongated primary mount extrusion 810 that is securable to the window portal attachment surface 801 with, for example, screws 80. The primary mount extrusion 810 has a vertical wall 814 with a top leg 812 and a bottom leg 820 both extending therefrom. The top leg 812 has a first end 816 that defines a first gasket engagement channel 818 for holding a resilient first elongated gasket 850. The bottom leg 820 has a second end 821 that defines a first one-way ratcheting engagement member 826.

An elongated mount stop extrusion 860 has a top end 861 that defines a second gasket engagement channel 862 for holding a resilient elongated second gasket 852. The mount stop extrusion also has a bottom end 863 that defines a second one-way ratcheting engagement member 864 that is complementary to the first one-way ratcheting engagement member 826. The mount stop extrusion 860 is affixed to the primary mount extrusion 810 when the second one-way ratcheting engagement member 864 is engaged with the first one-way ratcheting engagement member 826. Engagement can be done by pressing the second one-way ratcheting engagement member 864 into the first one-way ratcheting engagement member 826 and tapping it with a mallet. The elongated first gasket 850 and the elongated second gasket 852 can include, for example, an ethylene propylene diene monomer rubber and define a passage therebetween that has a width so that the glazing unit 82 fits therein.

The second end 821 of the primary mount extrusion 810 also defines a third one-way ratcheting engagement member 822. A plurality of spaced apart temps 840 are disposed between the primary mount extrusion 810 and the mount stop extrusion 860. Each temp has a bottom from which a fourth one-way ratcheting engagement member 842 extends. The fourth one-way ratcheting engagement member 842 is complementary to the third one-way ratcheting engagement member 822 so that when the fourth one-way ratcheting engagement member 842 is engaged with the third one-way ratcheting engagement member 822, the temp 840 is affixed to the primary mount extrusion 810. Each of the temps 840 includes a top portion that is configured to provide support to the glazing unit 82.

Figure 9A:
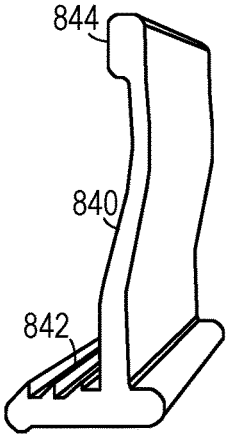
FIGS. 9A-9B are schematic diagrams of temps.
Figure 9B:
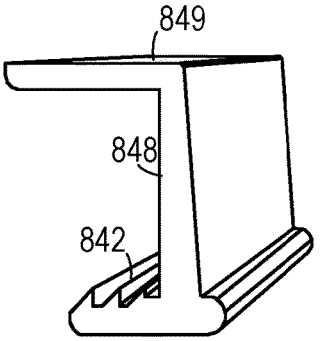
Figure 11A:
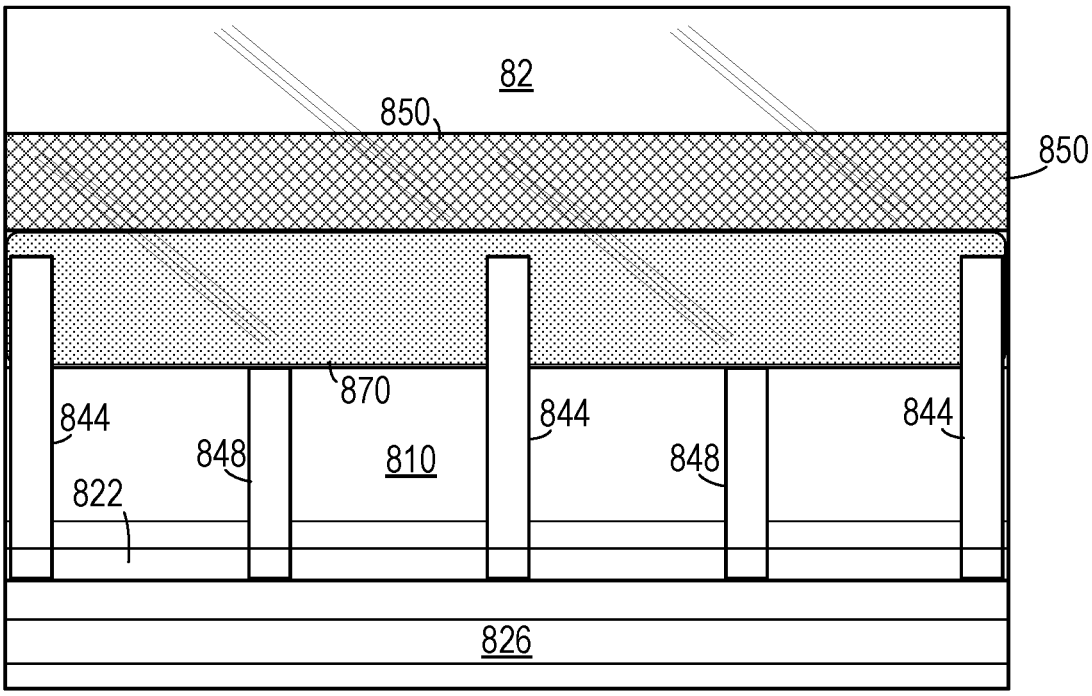
FIGS. 11A-11B are elevational views of a frame system with the mount stop extrusion removed.
Figure 11B:
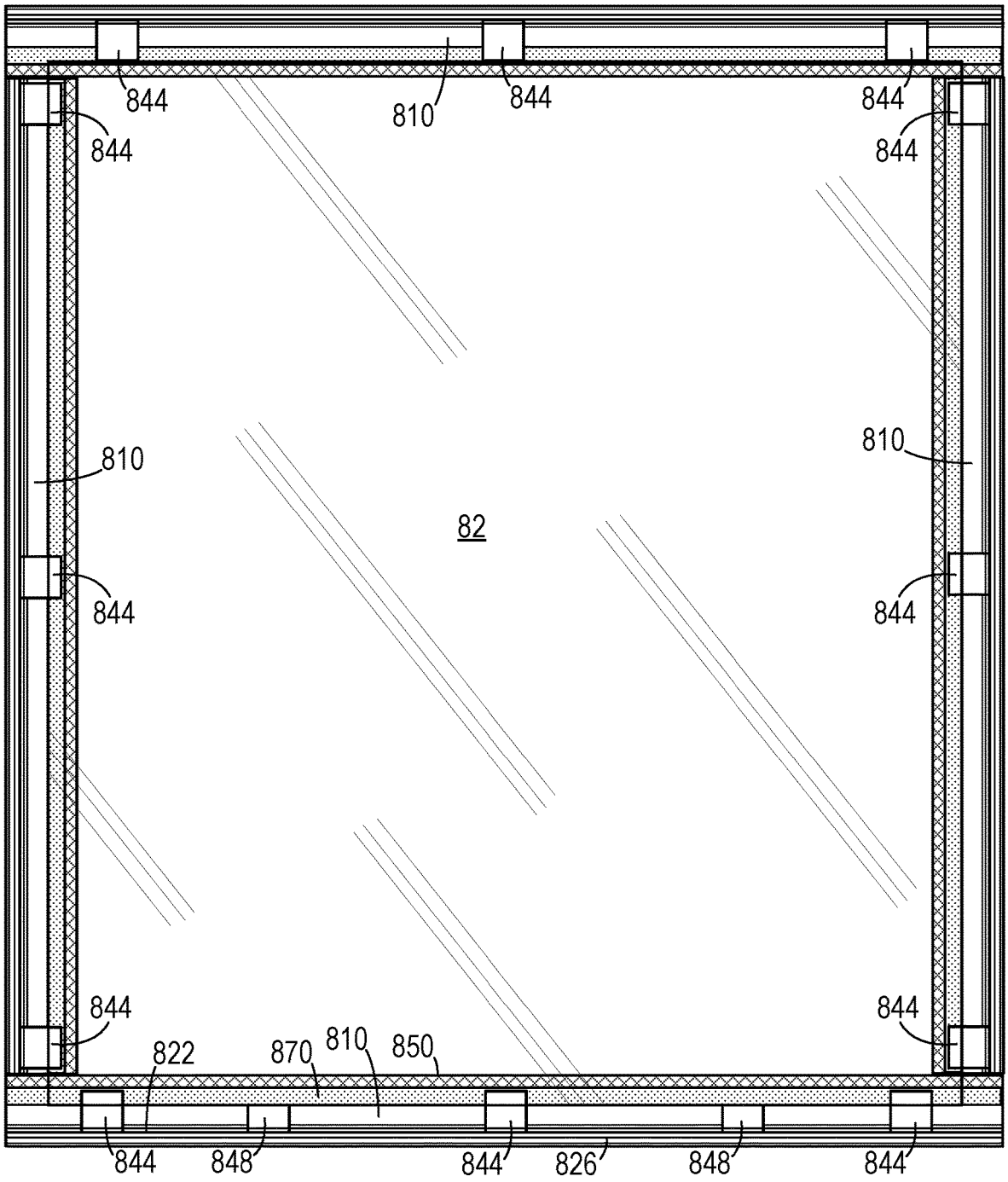

The spaced apart temps 840 can include a first set of temps 841, as shown in FIGS. 8A and 9A, and a second set of temps 848 (also referred to as "setting blocks"), as shown in FIGS. 8B and 9B. The first set of temps 841 have a vertical surface 844 that provide front-to-back support by exerting lateral force on the glazing unit 82, whereas the second set of temps 848 has a lateral shelf 849 that provides vertical support to the glazing unit 82 while the structural sealant cures during assembly of the frame system 800. The temps 841 of the first set are typically alternated with two temps 848 of the second set along the lower horizontal primary mount extrusion 810, as shown in FIG. 11A. Typically, only two temps of the second set are needed lower horizontal primary mount extrusion 810. In a rectangular frame, only temps of the first set are used in the vertical and upper horizontal primary mount extrusions 810, as shown in FIG. 11B.

Returning to FIGS. 8A-8C, a structural sealant 870 (such as structural silicone) is disposed so as to affix the glazing unit 82 to an inner upper surface 815 of the primary mount extrusion 810. The structural sealant 870 can be of a type that adheres to aluminum but that does not adhere to the material of the gaskets 850, 852.

When the attachment surface 801 of the window portal is a horizontal ledge, as shown in FIG. 8C, an elongated primary mount extrusion 810 is used which includes a frame extrusion member 829 that is configured to be secured to an anchor extrusion member 830. The frame extrusion member 829 defines a fifth ratcheting channel 824 and the anchor extrusion member 830 includes a complementary sixth ratcheting member 832.

To assemble this embodiment, the anchor extrusion member 830 is first secured to the ledge with a plurality of spaced apart screws 80. Then the ratcheting channel 824 is placed over the ratcheting member 832 and the frame extrusion member 829 is tapped into place with a mallet so as to form the primary mount extrusion 810. (Typically, the gaskets 850, 852 may be preinstalled at the factory.) The temps 840 are secured to the primary mount extrusion 810 and the glazing panel 82 is put into place. The structural sealant 870 is then injected between the glazing unit 82 and an inner upper surface 815 of the primary mount extrusion 810. The mount stop extrusion 860 is then affixed to the primary mount extrusion 810 by pressing the second one-way ratcheting engagement member 864 into the first one-way ratcheting engagement member 826 and tapping them together with a mallet until they are fully engaged. Thus, only one member (the anchor extrusion member 830) needs to be secured to the ledge 801 with screws 80 and the remaining members can be assembled simply by pressing them in and securing them into engagement with each other using a mallet—thereby greatly reducing the amount of labor required for installation.

In one embodiment, the primary mount extrusion 810 and the mount stop extrusion 860 include extruded aluminum. In one embodiment, the glazing unit 82 includes a security panel, such as a polycarbonate sheet. In an alternative embodiment, the glazing unit 82 can include a glass sheet.

Figure 10:
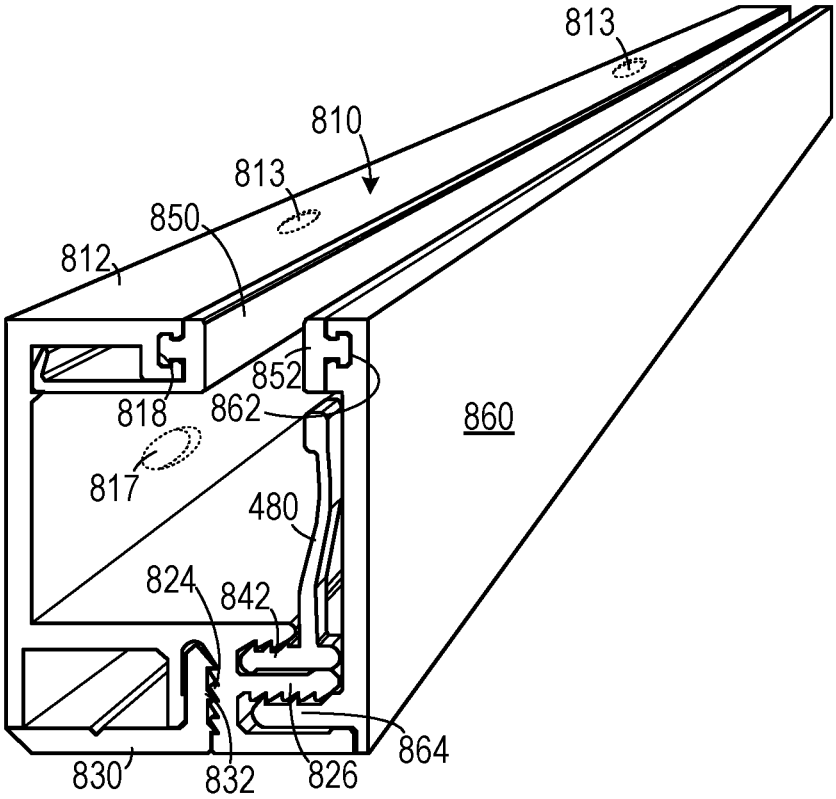
FIG. 10 is a perspective view of an embodiment configured for venting a void between a security panel and a window.

In one embodiment, as shown in FIG. 10, the glazing unit can include a security panel of the type disclosed above and shown in FIG. 1, in which the elongated primary mount extrusion 810 includes a plurality of air cavity vents 813 that communicate air from the void through holes in the glass unit frame via vent holes 817.

Figure 12:
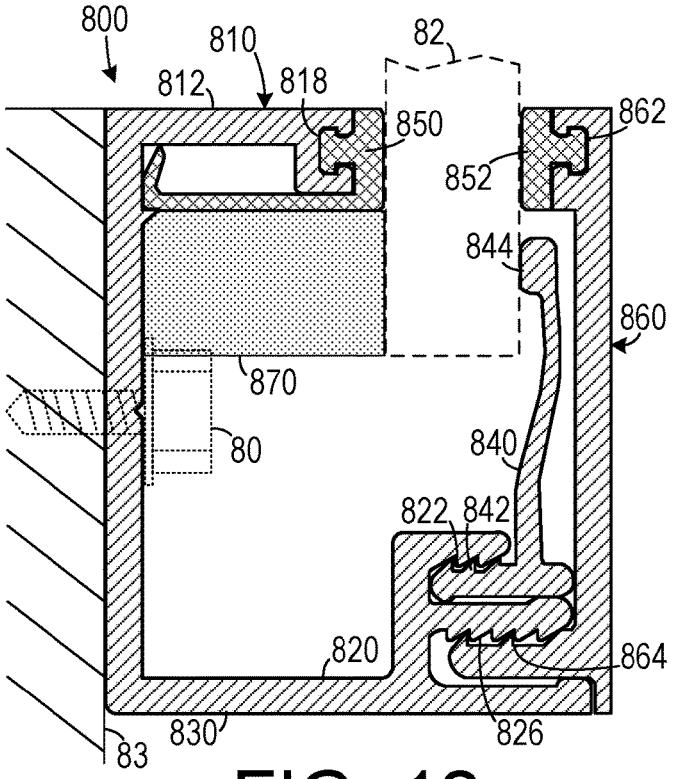
FIG. 12 is a schematic diagram of an embodiment for application to a vertical wall.

As shown in FIG. 12, in an embodiment for securing to a vertical wall 83, an anchor member is not required and primary mount extrusion 810 can be unitary extrusion.

Figure 13:
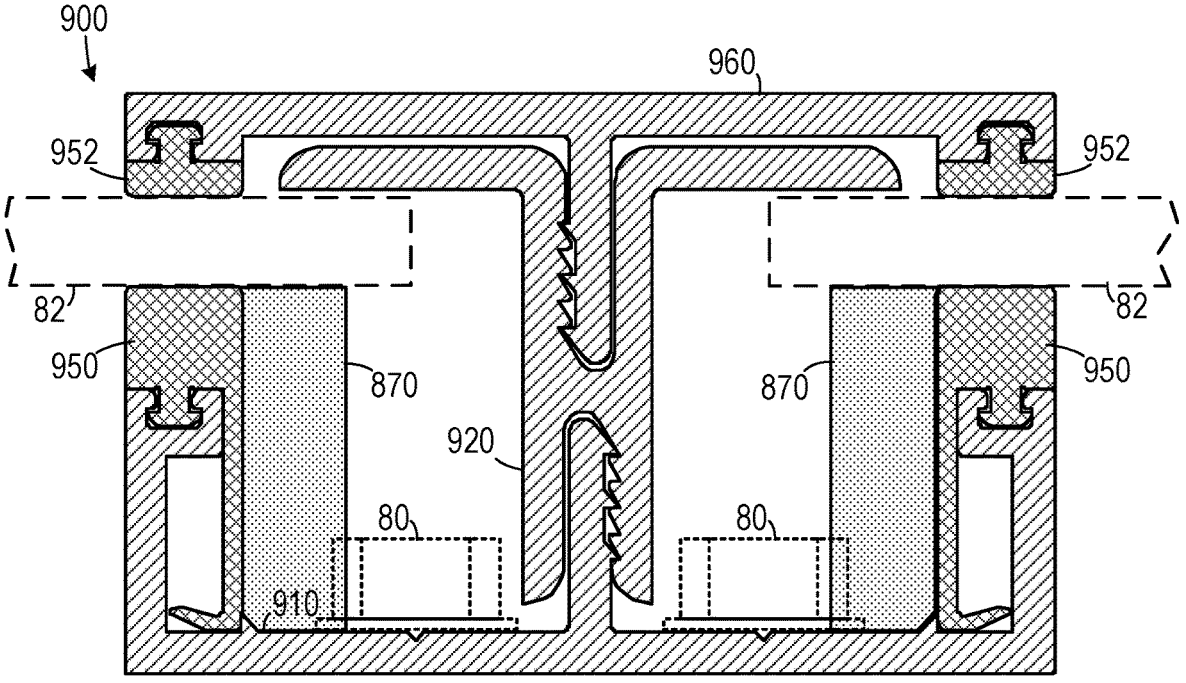
FIG. 13 is a schematic diagram of an embodiment for use with a mullion.
Figure 14A:
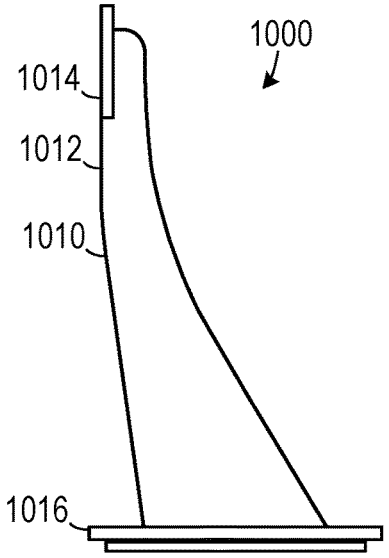
FIGS. 14A-14D are schematic diagrams of a tool used to inject the structural sealant.
Figure 14B:
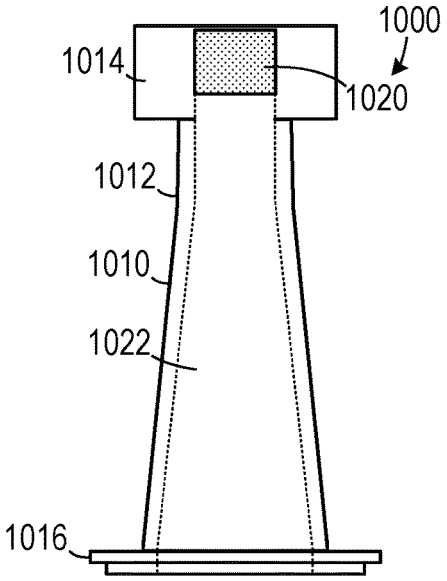
Figure 14C:
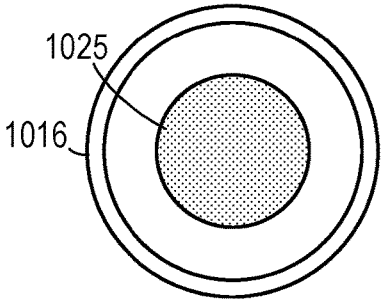
Figure 14D:
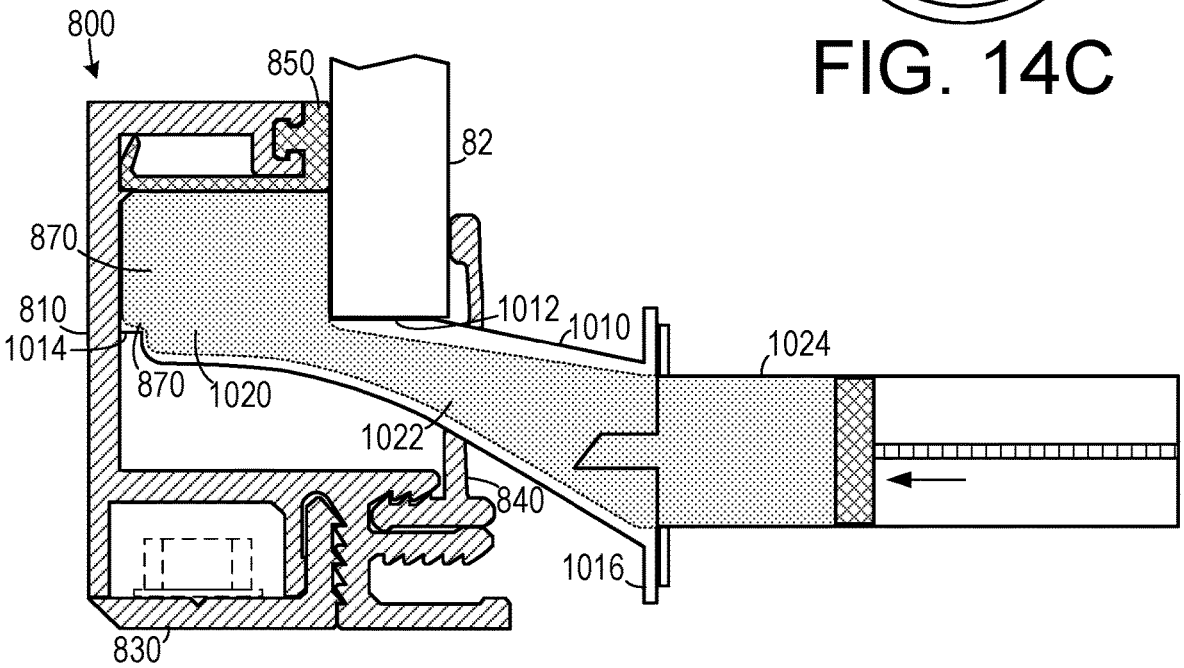

An example of a mullion 900 embodiment is shown in FIG. 13, in which the primary extrusion 910 includes a two-chambered member with two gaskets 950 attached thereto. A t-shaped intermediate member 920 holds two glazing units 82 in place and secures the t-shaped mount stop extrusion 960, which includes two gaskets 952 for contacting and dealing the glazing units 82.

As shown in FIGS. 14A-14D, the structural sealant 870 can be stored in a tube 1024 and injected using a tool 1000 that fits over the tube 1024. The tool 1000 includes a tapering structure 1010 that defines a channel 1022 running therethrough and opening to a base 1016, which defines an opening 1025 into which the nozzle of the tube 1024 fits. The tapering structure 1010 ends in a flat narrow portion 1012 with an integrated flange 1014 that defines an opening 1020 in communication with the channel 1022. In use, the flat narrow portion 1012 is placed between the temps 840 and against the glazing unit 82. A plunger pushes sealant 1022 in the space defined by the flange 1014, the glazing unit 82, the primary mount extrusion 810 and the gasket 850.

Although specific advantages have been enumerated above, various embodiments may include some, none, or all of the enumerated advantages. Other technical advantages may become readily apparent to one of ordinary skill in the art after review of the following figures and description. It is understood that, although exemplary embodiments are illustrated in the figures and described below, the principles of the present disclosure may be implemented using any number of techniques, whether currently known or not. Modifications, additions, or omissions may be made to the systems, apparatuses, and methods described herein without departing from the scope of the invention. The components of the systems and apparatuses may be integrated or separated. The operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set. It is intended that the claims and claim elements recited below do not invoke 35 U.S.C. § 112(f) unless the words "means for" or "step for" are explicitly used in the particular claim. The above-described embodiments, while including the preferred embodiment and the best mode of the invention known to the inventor at the time of filing, are given as illustrative examples only. It will be readily appreciated that many deviations may be made from the specific embodiments disclosed in this specification without departing from the spirit and scope of the invention. Accordingly, the scope of the invention is to be determined by the claims below rather than being limited to the specifically described embodiments above.

What is claimed is:

1. A frame system for securing a glazing unit to a window portal attachment surface, comprising:

(a) an elongated primary mount extrusion having a vertical wall with a top leg extending therefrom and a bottom leg extending therefrom, the top leg having a first end that defines a first gasket engagement channel, the bottom leg having a second end that defines a first one-way ratcheting engagement member, the primary mount extrusion configured to be secured to the window portal attachment surface;

(b) an elongated mount stop extrusion having a top end that defines a second gasket engagement channel spaced apart from and parallel to the first gasket engagement channel, the mount stop extrusion having a bottom end that defines a second one-way ratcheting engagement member that is complementary to the first one-way ratcheting engagement member so that the mount stop extrusion is affixed to the primary mount extrusion when the second one-way ratcheting engagement member is engaged with the first one-way ratcheting engagement member;

(c) an elongated first gasket that is configured to be engaged with the first gasket engagement channel and an elongated second gasket that is configured to be engaged with the second gasket engagement channel, the first gasket and the second gasket defining a passage therebetween once engaged, the passage having a width so that the glazing unit fits therein; and (d) a structural sealant that is configured to be disposed so as to affix the glazing unit to an inner upper surface of the primary mount extrusion.

2. The frame system of claim 1, wherein the second end of the primary mount extrusion further defines a third one-way ratcheting engagement member and further comprising a plurality of spaced apart temps that are configured to be disposed between the primary mount extrusion and the mount stop extrusion, each temp having a bottom from which a fourth one-way ratcheting engagement member extends, the fourth one-way ratcheting engagement member complementary to the third one-way ratcheting engagement member so that when the fourth one-way ratcheting engagement member is engaged with the third one-way ratcheting engagement member, the temp is affixed to the primary mount extrusion, each of the plurality of spaced apart temps including a top portion that is configured to provide support to the glazing unit.

3. The frame system of claim 2, wherein the plurality of spaced apart temps includes a first set and a second set, wherein each of the first set temps is configured to provide front-to-back support to the glazing unit and wherein each of the second set of temps is configured to provide vertical support to the glazing unit and wherein temps of the first set are alternated with temps of the second set along the primary mount extrusion.

4. The frame system of claim 3, wherein the temps of the first set include a vertical arm extending from the bottom, the vertical arm having a top portion that exerts lateral force on the glazing unit while the frame system is assembled, and wherein in the temps of the second set include a lateral shelf that provides vertical support to the glazing unit while the frame system is assembled.

5. The frame system of claim 1, wherein the structural sealant comprises structural silicone.

6. The frame system of claim 1, wherein the primary mount extrusion and the mount stop extrusion each comprise aluminum.

7. The frame system of claim 1, wherein the first gasket and the second gasket each comprise ethylene propylene diene monomer rubber.

8. The frame system of claim 1, wherein the attachment surface of the window portal comprises a horizontal ledge and wherein the primary mount extrusion comprises a frame extrusion member that is configured to be secured to an anchor extrusion member, wherein the anchor extrusion member is configured to be secured to the ledge.

9. The frame system of claim 8, wherein the frame extrusion member includes a fifth ratcheting engagement member and wherein the anchor extrusion member comprises a sixth ratcheting engagement member that is complementary to the fifth ratcheting engagement member.

10. The frame system of claim 1, wherein the attachment surface of the window portal includes a vertical wall and wherein the primary mount extrusion is configured to be secured to the vertical wall.

11. The frame system of claim 1, wherein the glazing unit comprises a security panel that is spaced apart from a glass window unit having a glass unit frame, wherein the security panel is supported by the frame system so that the security panel and the glass window unit define a void therebetween, wherein the elongated primary mount extrusion includes a plurality of air cavity vents that communicate air from the void through holes in the glass unit frame.

12. A window system, comprising:

(a) a glazing unit;

(b) an elongated primary mount extrusion having a vertical wall with a top leg extending therefrom and a bottom leg extending therefrom, the top leg having a first end that defines a first gasket engagement channel, the bottom leg having a second end that defines a first one-way ratcheting engagement member, the primary mount extrusion secured to a window portal attachment surface;

(c) an elongated mount stop extrusion having a top end that defines a second gasket engagement channel spaced apart from and parallel to the first gasket engagement channel, the mount stop extrusion having a bottom end that defines a second one-way ratcheting engagement member that is complementary to the first one-way ratcheting engagement member so that the mount stop extrusion is affixed to the primary mount extrusion when the second one-way ratcheting engagement member is engaged with the first one-way ratcheting engagement member;

(d) an elongated first gasket that is engaged with the first gasket engagement channel and an elongated second gasket that is engaged with the second gasket engagement channel, the first gasket and the second gasket defining a passage therebetween once engaged, the passage having a width so that the glazing unit fits therein; and (e) a structural sealant that is disposed so as to affix the glazing unit to an inner upper surface of the primary mount extrusion.

13. The window system of claim 12, wherein the second end of the primary mount extrusion further defines a third one-way ratcheting engagement member and further comprising a plurality of spaced apart temps that are configured to be disposed between the primary mount extrusion and the mount stop extrusion, each temp having a bottom from which a fourth one-way ratcheting engagement member extends, the fourth one-way ratcheting engagement member complementary to the third one-way ratcheting engagement member so that when the fourth one-way ratcheting engagement member is engaged with the third one-way ratcheting engagement member, the temp is affixed to the primary mount extrusion, each of the plurality of spaced apart temps including a top portion that is configured to provide support to the glazing unit.

14. The window system of claim 13, wherein the plurality of spaced apart temps includes a first set and a second set, wherein each of the first set temps is configured to provide front-to-back support to the glazing unit and wherein each of the second set of temps is configured to provide vertical support to the glazing unit and wherein temps of the first set are alternated with temps of the second set along the primary mount extrusion.

15. The window system of claim 14, wherein the temps of the first set include a vertical arm extending from the bottom, the vertical arm having a top portion that exerts lateral force on the glazing unit while the frame system is assembled, and wherein in the temps of the second set include a lateral shelf that provides vertical support to the glazing unit while the frame system is assembled.

16. The window system of claim 12, wherein the structural sealant comprises structural silicone.

17. The window system of claim 12, wherein the primary mount extrusion and the mount stop extrusion each comprise aluminum.

18. The window system of claim 12, wherein the first gasket and the second gasket each comprise ethylene propylene diene monomer rubber.

19. The window system of claim 12, wherein the window portal attachment surface comprises a horizontal ledge and wherein the primary mount extrusion comprises a frame extrusion member that is secured to an anchor extrusion member, wherein the anchor extrusion member is secured to the ledge.

20. The window system of claim 19, wherein the frame extrusion member includes a fifth ratcheting engagement member and wherein the anchor extrusion member comprises a sixth ratcheting engagement member that is complementary to and engaged with the fifth ratcheting engagement member.

21. The window system of claim 12, wherein the window portal attachment surface includes a vertical wall and wherein the primary mount extrusion is secured to the vertical wall.

22. The window system of claim 12, wherein the glazing unit comprises a polycarbonate panel that is spaced apart from a window.

23. The window system of claim 12, wherein the glazing unit comprises a glass panel.

* * * * *